US006708778B2

(12) United States Patent
Tokunaga

(10) Patent No.: US 6,708,778 B2
(45) Date of Patent: Mar. 23, 2004

(54) HYDRAULIC UNIT WITH INCREASED TORQUE

(75) Inventor: Manabu Tokunaga, Toyoake (JP)

(73) Assignee: Makita Corporation, Anjo (JP)

( * ) Notice: Subject to any disclaimer, the term of this patent is extended or adjusted under 35 U.S.C. 154(b) by 169 days.

(21) Appl. No.: 10/045,172

(22) Filed: Jan. 11, 2002

(65) Prior Publication Data

US 2002/0112868 A1 Aug. 22, 2002

(30) Foreign Application Priority Data

Jan. 12, 2001 (JP) ..... 2001-005478
Apr. 10, 2001 (JP) ..... 2001-111685

(51) Int. Cl.[7] ..... B25B 21/02

(52) U.S. Cl. ..... 173/93.5; 173/93; 173/93.5; 173/104; 173/105

(58) Field of Search ..... 173/93, 93.5, 93.6, 173/104, 105

(56) References Cited

U.S. PATENT DOCUMENTS 4,766,787 A * 8/1988 Sugimoto et al. ..... 173/93.5
4,785,693 A * 11/1988 Minamiyama et al. ..... 173/93.5
4,838,133 A * 6/1989 Dainin ..... 173/93.5
5,172,772 A 12/1992 Kettner et al. ..... 173/93
5,775,439 A * 7/1998 Biek ..... 173/93.5
5,813,478 A * 9/1998 Kettner ..... 173/93
6,334,494 B1 * 1/2002 Nagato ..... 173/93

FOREIGN PATENT DOCUMENTS

| | | |
|---|---|---|
| EP | 676260 A1 | 10/1995 |
| JP | 06-27341 | 2/1990 |
| JP | 05-253858 | 10/1993 |
| JP | 08-197443 | 8/1996 |

* cited by examiner

*Primary Examiner*—Rinaldi I. Rada
*Assistant Examiner*—Michelle López
(74) *Attorney, Agent, or Firm*—Lahive & Cockfield, LLP; Anthony A. Laurentano

(57) ABSTRACT

A hydraulic unit includes a case, a liner contained in the case, and a top cap and an opposing bottom cap plugged at the front and rear ends of the case. The unit further includes a spindle disposed in the liner and provided with a large diameter section. The large diameter section has a pair of blades with one having longer first pins and the other having shorter second pins on their front and rear end surfaces. A first oblong cam recess and a second oblong cam recess having a longer longitudinal axis and a shallower depth than the first recess are formed in the opposing inner surfaces of the bottom cap and the top cap. During rotation of the case, the cam recesses guide the first and second pins on the blades while preventing the blades from sliding on second sealing surfaces of the liner, which are associated with ribs on the spindle.

18 Claims, 8 Drawing Sheets

10°

10°

HYDRAULIC UNIT WITH INCREASED TORQUE

RELATED APPLICATION

This application claims the benefit and priority of Japanese Patent Application No. 2001-005478, filed Jan. 12, 2001, and Japanese Patent Application No. 2001-111685, filed Apr. 10, 2001, the contents of which are incorporated herein by reference.

FIELD OF THE INVENTION

The present invention relates to hydraulic units for use in electric power tools such as torque wrenches for generating pulsating instantaneous torque by means of hydraulic pressure.

BACKGROUND OF THE INVENTION

FIG. 6 shows a conventional hydraulic unit 50. The hydraulic unit includes a cylindrical case 51 which integrally accommodates a liner 52 coupled to the output shaft of a tool motor for receiving torque therefrom. The hydraulic unit 50 further includes front and rear caps (not shown) as closing elements that plug the axial front and rear ends of the case 51, thus forming a fluid chamber 53 therein. The front and rear caps also rotatably support a spindle 54 within the fluid chamber 53. Furthermore, inserted radially in the spindle 54 is a pair of blades 55 that are biased generally outwardly in mutually opposing directions by a coil spring 62 so that the blades can be retracted into the spindle when inward pressure exceeding the biasing force of the coil spring is applied to the top surfaces of the blades 55. The spindle 54 additionally includes a pair of ribs 56 which protrudes therefrom at diametrically opposite positions and which are 90 degrees phase-shifted from the blades 55. Formed at the axial front and rear ends of the liner 52 are two generally oblong guide holes 57 along which the top surfaces of the blades 55 slide. Two axially extending first sealing bodies 58 are disposed between the guide holes 57, with each sealing body 58 provided with a first sealing surface 59 which is flush with and conforms to the interior surface of the guide hole 57. Additionally, two axially extending second sealing bodies 60 are disposed between the guide holes 57, with each sealing body 60 provided with a second sealing surface 61 which also conforms to the interior surface of the guide hole 57. The first sealing bodies 58 are 90 degrees phase-shifted from the second sealing bodies 60. As shown in FIG. 6A, in the operation of the electric power tool, as the liner 52 rotates in the direction indicated in the arrow, the blades 55 rotate relative to the case 51 along the interior surfaces of the guide holes 57. When the blades 55 reach the first sealing surfaces 59 and the ribs 56 reach the second sealing surfaces 61, the fluid chamber 53 are divided into four partitions, creating alternate high and low pressure chambers. This differential pressure in the fluid chamber causes generation of impact torque (generation of a hydraulic impulse) to the spindle 54. One example of such an hydraulic unit is disclosed in Japanese Published Examined Utility Model Application No. 6-27341.

In the foregoing hydraulic unit 50, upon generation of a hydraulic impulse, the liner 52 continues its rotation, thus removing the blades 55 and the ribs 56 from the first and second sealing surfaces 59 and 61, respectively. As the seal within the fluid chamber 53 is opened at this moment, no hydraulic impulse is generated, such that the liner 52 alone rotates (FIG. 6B). As the liner 52 continues its rotation, the blades 55 slide along the interior surfaces of the guide holes 57, approaching the second sealing surfaces 61. As this gradually pushes the blades 55 into the spindle 54, the basing force of the coil spring 62 against the blades 55 increases (FIG. 6C) until it peaks when the blades reaches the second sealing surfaces 61 (FIG. 6D). Accordingly, the blades' pressure on the interior surfaces of the guide holes 57 acts as rotational resistance to the spindle 54, thus impeding its rotation. In addition, as illustrated, the cross section of the guide holes 57 is a combination of three circles such that the guide holes 57 have low axial ridges on both sides of each second sealing surface 61, where the intermediate circle intersects the two side circles. Thus, as shown in FIG. 6D, when the blades 55 ride over the intersection points P, additional resistance to rotation of the blades 55 is created.

FIG. 8 is a graph showing a pattern of torque production in the conventional hydraulic unit 50. Peaks "a" indicate intended torque produced by hydraulic impulses, whereas lower torque peaks "b" are produced between these hydraulic impulses by the above-described rotational resistance. Such useless low torque disadvantageously decreases the intended torque produced by hydraulic impulses.

FIG. 7 shows another conventional hydraulic unit 50' similar to the foregoing conventional hydraulic unit 30. FIGS. 7A–L are similar to FIGS. 6A–D, but they show the movement of the blades 55' with respect to the case 51' in a more detailed sequence, with each figure depicting unit's parts or elements in the position 10 degrees further rotated from the position in the immediately preceding figure. Additionally, identical or similar reference numerals or characters denote identical or similar parts or elements of those in FIG. 6 throughout the several views. Therefore, description of such elements is omitted.

As shown in FIGS. 7A–C, when the blades 55' and the ribs 56' reach the first and second sealing bodies 58' and 60', respectively, with the counterclockwise rotation of the case 51' and the liner 52', the fluid chamber 53' is divided into four partitions or sub-chambers, thus producing impact torque (hydraulic impulse), as in the foregoing unit 30. Referring to FIGS. 7D–L, following the production of impact torque, as the liner 52' continues to rotate, the blades 55' are gradually retracted into the spindle 54' against the biasing force of the coil spring and eventually slide across the second sealing bodies 60' over the ridges on the inner surfaces of the guide holes 57'. Compared to FIG. 6, FIGS. 7D–L illustrate in greater detail the increased resistance to the rotation of the spindle 54' due to the cross section of the guide holes 57' being a combination of three circles.

Moreover, as the cross section of the guide holes has a complex shape due to the combination of three intersecting circles, the interior surfaces of the guide holes 57' requires high-precision polishing, thus increasing the number of manufacturing steps and resulting in higher cost.

In the foregoing hydraulic unit 60', the cross section of the guide holes 57' of the liner 52' is a combination of three circles, and the first and second sealing bodies 58' are required, thus making the entire structure of the liner complex.

SUMMARY OF THE INVENTION

In view of the above-identified problems, the present invention provides a hydraulic unit wherein the rotational resistance to the spindle can be effectively reduced except upon generation of hydraulic impulses, thus augmenting the torque produced by such hydraulic impulses.

The present invention also provides a hydraulic unit which has a simplified construction and thus a greater cost advantage over conventional hydraulic units.

In accordance with one embodiment of the present invention a hydraulic unit is provided including a generally cylindrical case containing working fluid, with the case including an interior surface, front and rear closing elements at two axial ends thereof, and at least one first blade-sealing surface and at least one second rib-sealing surface. The hydraulic unit further includes a spindle which is inserted into the case and includes front and rear ends rotatably supported by the front and rear closing elements, respectively, with the spindle further including at regular intervals at least one blade and at least one rib for circumferentially partitioning an interior of the case into a plurality of smaller fluid chambers whereby relative rotation between the case and the spindle causes top surfaces of the at least one blade and the at least one rib to slide along the interior surface of the case so as to create differential pressure among the small fluid chambers when the top surfaces of the blade and the rib reach the first and second sealing surfaces, respectively, thus generating instantaneous torque to the spindle. Additionally included in the hydraulic unit are a pair of pins provided on axial front and rear ends of each blade and cam recesses provided in opposing inner surfaces of the closing elements of the case. In this hydraulic unit, during rotation of the case, the cam recesses guide the pins and prevent the top surfaces of the blades from sliding on the second rib-sealing surfaces. This arrangement completely eliminates the rotational resistance created by the top surfaces of the blades riding over the sealing surfaces associated with the ribs, thereby maximizing the torque resulting from intended hydraulic impulses. It should be noted that as used herein, the term "oblong" is intended to include "elliptical" as well as "elongated circle."

In accordance with one aspect of the present invention, the spindle includes first and second blades, the case includes two second blade-sealing surface, the first blade is provided with two first pins, the second blade is provided with two second pins shorter than the first pins, and each closing element includes in its inner surface a first oblong cam recess for guiding one of the first pins and a second oblong cam recess shallower than the first cam recess for guiding one of the second pins. In this aspect, each first cam recess shares a common longitudinal end portion with the second cam recess and has a shorter longitudinal axis than the second cam recess such that the first blade is prevented from coming into slidable abutment with one of the second blade-sealing surfaces by the first recess guiding the first pins. This ensures generation of one hydraulic impulse per rotation of the case, which further augments the unit's output torque each time torque is generated.

In accordance with another aspect of the present invention, while the first recesses prevent the first blade from coming into abutment with one of the blade-sealing surfaces, the second recesses cooperate with the second pins to permit the second blade to protrude into abutment with the other blade-sealing surface.

In accordance with yet another aspect of the present invention, the first and second blade are located diametrically opposite about the axis of the spindle, two ribs are positioned diametrically opposite about the axis of the spindle and 90 degrees phase-shifted from the blades, two rib-sealing surfaces are positioned diametrically opposite about the center axis of the interior surface of the case, the longitudinal axes of the first and second cam recesses are oriented orthogonal to a diameter of the case passing through the rib-sealing surfaces, and the widthwise axes of the second cam recesses pass through the axis of the spindle and are oriented orthogonal to the longitudinal axes of the first and second cam recesses, and the center of the second cam recess is located at the axis of the spindle. In this arrangement, when the case is at a first rotational position, the rib-sealing surfaces oppose the ribs and each second pin is located on the longitudinal axis of the associated second cam recess in the longitudinal end portion of the second recess not shared with the first recess while each first pin is located on the longitudinal axis of the first and second recess in the longitudinal end portion shared by the first and second recesses so as to allow the blades to be biased into abutment with the interior surface, thus producing instantaneous torque, and at a second rotational position of the case, rotated a further 180 degrees from the first rotational position, each second pin is located on the common longitudinal axes of the first and second cam recesses in the longitudinal end portion shared by the recesses and each first pin is located on the longitudinal axes of the first cam recess in the first cam's longitudinal end portion not shared with the second cam recess, thus preventing the first blade from coming into abutment with the interior surface.

In accordance with still another aspect of the present invention, the widthwise axes of the first and second cam recesses are selected so as to have a common and sufficiently short length to cause the blades to be retracted into the spindle when the case is at a third rotational position, rotated a further 90 degrees from the first position, where the first and second pins are located approximately on the widthwise axes of the second cam recesses, with the blades passing by the rib-sealing surfaces.

According to one feature of the present invention, each cam recess includes a pair of opposing semicircular walls and a pair of parallel liner walls connecting the semicircular walls, thus forming a continuous loop surface extending parallel with the axis of the spindle, and additionally, each of the aforementioned longitudinal end portions shared by the first cam recess and the associated second cam recess includes one semicircular wall and at least part of each liner wall.

According to another feature of the present invention, following the retraction of the blades into the spindle, when the case is at the third rotational position, the case returns to the first rotational position upon rotating a further 270 degrees, such that instantaneous torque is produced to the spindle once for each complete rotation of the case.

According to still another feature of the present invention, the hydraulic unit further includes a pair of coil springs disposed between the blades within the spindle for biasing the blades in outwardly radial directions, and the first and second pins are inserted in the respective first and second recesses. Additionally, the length of each second pin in the recesses is shorter than the portion shared by the first and second recesses and the length of each first pin in the cam recesses is shorter than the depth of the first cam recess and greater than the depth of the portion shared by the first and the second cam recesses.

According to yet another feature of the present invention, the case further includes a liner which is integrally rotatable with the case and defines the interior surface of the case, a transversal cross section of the interior surface of the case has an approximately oblong shape of a combination of three circles whose centers are located on a common straight line such that two pairs of axial ridges are symmetrically formed about the common line where the intermediate circle intersects the two side circles. The case further includes two rib-sealing surfaces, each of which is located at an intermediate position between the two ridges on either side of the common line and flush with the interior surface of the case, and the spindle further includes a large diameter section between the rear and front ends thereof, the large diameter section having a transversal cross section complementary to and snugly fitting in the intermediate circle, and the large diameter section includes two pairs of mutually parallel axial chamfers formed in an outer peripheral surface thereof to define one of the ribs between each pair such that when the rib-sealing surfaces of the case are displaced by rotation from the ribs, the chamfers undo the sealing provided by the rib-sealing surfaces opposing the ribs. In addition, the rib-sealing surfaces oppose the outer peripheral surface of the large diameter section except when the rib-sealing surfaces oppose the chamfers, whereas the case further including thereon two blade-sealing surfaces which are 90 degree phase-shifted from the rib-sealing surfaces.

In accordance with one embodiment, a hydraulic unit includes: a generally cylindrical case containing working fluid, with the case including an interior surface and front and rear closing elements at two axial ends thereof; a spindle which is inserted into the case and includes front and rear ends coaxially and rotatably supported by the front and rear closing elements, respectively, the spindle further including at least one axially extending sealing surface and at least one blade which is biased radially into abutment with the interior surface of the case for circumferentially partitioning a fluid chamber defined between the case and the spindle; at least one axially extending sealing body protruding from the interior surface of the case and opposing the at least one sealing surface of the spindle for sealing the fluid chamber when the case is at a predetermined rotational position; a pair of pins provided on axial front and rear ends of each blade; and cam recesses provided in opposing inner surfaces of the closing elements for guiding the pins during rotation of the case and retracting the blades into the spindle when the at least one sealing body passes by the at least one blade, in which while relative rotation between the case and the spindle causes a top surface of the at least one blade to slidably abut the interior surface of the case, the at least one sealing body opposes the at least one sealing surface so as to divide the fluid chamber into smaller chambers, thus creating differential pressure among the smaller chambers, thus producing instantaneous torque to the spindle. Furthermore, the interior surface of the case has a circular shape coaxial with an axis of the spindle. Since the interior surface of the case has a simple circular cross-section coaxial with the spindle, the case functions as a liner in conventional arrangements, thus reducing the number of components in the foregoing hydraulic unit. In addition, as the interior surface of the case need only be machined to a simple circular hole, eliminating the need for high-precision polishing, as is required for complexly shaped interior surfaces of conventional units, and significantly lowering the cost and number of steps required in manufacturing the hydraulic unit.

In accordance with one aspect of the present invention, the spindle includes first and second blades and the case includes two sealing bodies, the first blade is provided with two first pins, and the second blade is provided with two second pins longer than the first pins. Moreover, each closing element includes in its inner surface a first oblong cam recess for guiding one of the first pins and a second oblong cam recess deeper than the first cam recess for guiding one of the second pins. Each second cam recess shares a common longitudinal end portion with the first cam recess and has a shorter longitudinal axis than the first cam recess such that, following the retraction of the blades into the spindle, the second recesses prevent the second blade from coming into abutment with the interior surface of the case until the case further rotates a predetermined angle while the first recesses cooperate with the first pins to permit the first blade to protrude into abutment with the interior surface of the case.

In accordance with another aspect of the present invention, the first and second blade are located diametrically opposite about the axis of the spindle, two sealing surfaces are positioned diametrically opposite about the axis of the spindle and 90 degrees phase-shifted from the blades, and two sealing bodies are positioned diametrically opposite about the axis of the interior surface of the case. Additionally, the longitudinal axes of the first and second cam recesses are oriented orthogonal to a diameter of the case passing through the sealing bodies, the widthwise axes of the first cam recesses pass through the axis of the spindle and are oriented orthogonal to the longitudinal axes of the first and second cam recesses, and the center of the first cam recess is located at the axis of the spindle. In this arrangement, when the case is at a first rotational position, the sealing bodies oppose the sealing surfaces and each first pin is located on the longitudinal axis of the associated first cam recess in the longitudinal end portion of the first recess not shared with the second recess while each second pin is located on the longitudinal axis of the first and second recesses in the longitudinal end portion shared by the first and second recesses so as to allow the blades to be biased into abutment with the interior surface of the case, thus producing instantaneous torque. At a second rotational position of the case, rotated a further 180 degrees from the first rotational position, each first pin is located on the common longitudinal axes of the first and second cam recesses in the longitudinal end portion shared by the recesses and the second pin is located on the longitudinal axis of the second cam recess in the second cam's longitudinal end portion not shared with the first cam recess, thus preventing the second blade from coming into abutment with the interior surface.

In accordance with yet another aspect of the present invention, the widthwise axes of the first and second cam recesses are selected so as to have a common and sufficiently short length to cause the blades to be retracted into the spindle when the case is at a third rotational position, rotated a further 90 degrees from the first position, where the first and second pins are located approximately on the widthwise axes of the first cam recesses, with the blades passing by the sealing bodies.

In accordance with still another aspect of the present invention, the spindle includes an outer peripheral surface having a circular cross-section coaxial with the interior surface of the case. The spindle further includes two pairs of mutually parallel axial chamfers formed therein to define one of the sealing surfaces between each pair such that when the sealing bodies of the case are displaced by rotation from the sealing surfaces, the chamfers undo the sealing provided by the sealing bodies opposing the sealing surfaces.

In accordance with one aspect of the present invention, the sealing bodies oppose the outer peripheral surface of the spindle except when the sealing bodies oppose the chamfers.

In accordance with another aspect of the present invention, each cam recess includes a pair of opposing semicircular walls and a pair of parallel liner walls connecting the semicircular walls, thus forming a continuous loop surface extending parallel with the axis of the spindle. In addition, each of the aforementioned longitudinal end portions shared by each first cam recess and the associated second cam recess includes one semicircular wall and at least part of each liner wall.

In accordance with one aspect of the present invention, the hydraulic unit further includes a pair of coil springs disposed between the blades within the spindle for biasing the blades in outwardly radial directions.

In accordance with another aspect of the present invention, following the retraction of the blades into the spindle when the case is at the third rotational position, the case returns to the first rotational position upon rotating 270 degrees further, such that instantaneous torque is produced to the spindle once for each complete rotation of the case.

In accordance with still another aspect of the present invention, the first and second pins are inserted in the respective first and second recesses. Moreover, the length of each first pin in the recesses is shorter than the depth of the portion shared by the first and second recesses, whereas the length of each second pin in the cam recesses is shorter than the depth of the second cam recess and greater than the depth of the portion shared by the first and the second cam recesses.

Other general and more specific objects of the invention will in part be obvious and will in part be evident from the drawings and descriptions which follow.

BRIEF DESCRIPTION OF THE DRAWINGS

For a fuller understanding of the nature and objects of the present invention, reference is made to the following detailed description and the accompanying drawings, in which.

DETAILED DESCRIPTION

Figure 1A:
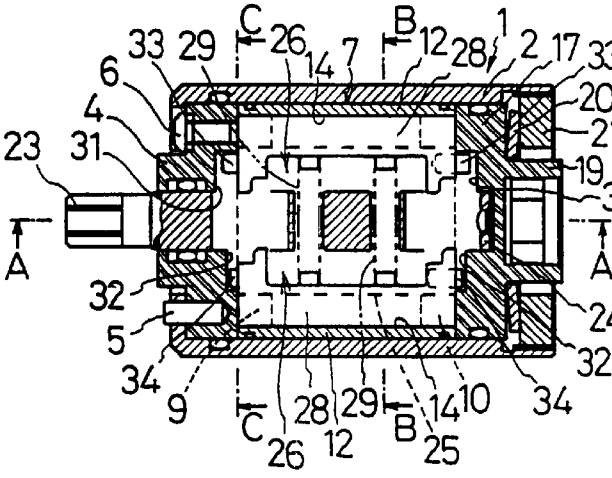
FIG. 1A is a cross-sectional view of a hydraulic unit according to an embodiment of the present invention taken along the axial line.

FIGS. 1A through 8, wherein like parts are designated by like reference numerals throughout, illustrate examples embodiment of the hydraulic unit according to the present invention. Although the present invention will be described with reference to the example embodiments illustrated in the figures, it should be understood that many alternative forms can embody the present invention. One of ordinary skill in the art will additionally appreciate different ways to alter the parameters of the embodiments disclosed, such as the size, shape, or type of elements or materials, in a manner still in keeping with the spirit and scope of the present invention.

First Embodiment

Figure 1B:
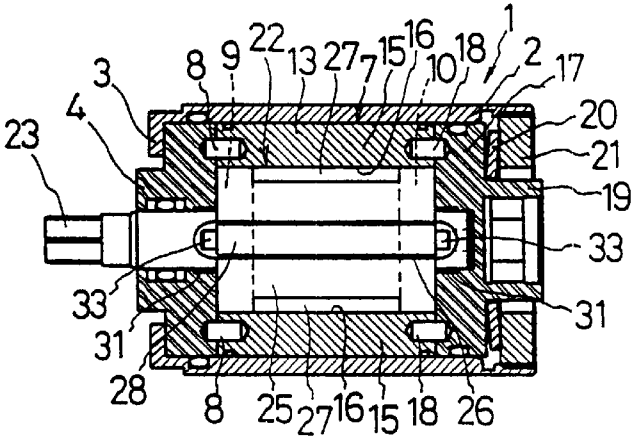
FIG. 1B is a cross-sectional view of the hydraulic unit taken along line A—A in FIG. 1A.
Figure 1C:
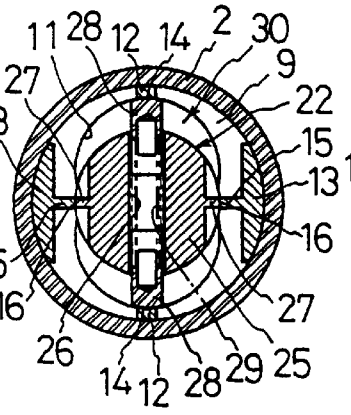
FIG. 1C is a cross-sectional view of the hydraulic unit taken along line B—B in FIG. 1A.
Figure 1D:
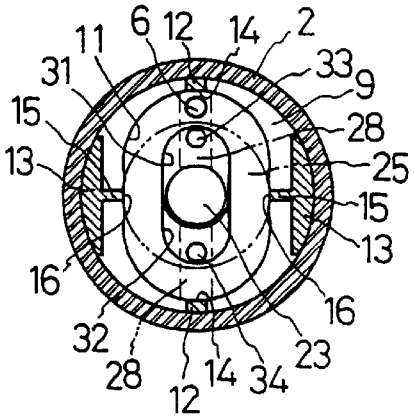
FIG. 1D is a cross-sectional view of the hydraulic unit taken along line C—C in FIG. 1A.

FIG. 1A is a cross-sectional view of a hydraulic unit 1 according to an embodiment of the present invention taken along the axial line, FIG. 1B is a cross-sectional view of the hydraulic unit taken along line A—A in FIG. 1A, FIG. 1C is a cross-sectional view of the hydraulic unit taken along line B—B in FIG. 1A, and FIG. 1D is a cross-sectional view of the hydraulic unit taken along line C—C in FIG. 1A. The hydraulic unit 1 includes a cylindrical case 2. Plugging the forward part of the cylindrical case 2 (with the front of the case shown as being on the left side of FIG. 1A) from the rear is a closing element such as a disk-shaped bottom cap 4 which is inserted into the cylindrical case 2 and abuts the rear surface of a restrainer 3. A spring pin 5 passes through a gap in the restrainer 3, penetrating the bottom cap 4 so as to rotatably integrate the bottom cap 4 with the case 2. A bolt 6 screwed into the bottom cap 4 via a gap in the restrainer 3 provides a passage through which working fluid is supplied.

Additionally, a rotatable liner 7 disposed to the rear of the bottom cap 4 is integrally connected to the bottom cap 4 with a plurality of pins 8. The liner 7 has a generally cylindrical shape, composed of a front plate 9 and a rear plate 10 connected to each other with an opposing pair of first sealing bodies 12 and an opposing pair of second sealing bodies 13. Each of the front and rear plate 9 and 10 defines in its interior an approximately oblong or elongated circular guide hole 11 whose cross section is a combination of three circles. As illustrated, the first sealing bodies 12 oppose each other along the longitudinal axis of each guide hole 11, whereas the second sealing bodies 13 oppose each other along the widthwise axis of each guide hole 11. In addition, the first sealing bodies 12 are provided with mutually opposing first sealing surfaces 14 which generally are flush with and conform to the interior surfaces of the guide holes 11. Likewise, the second sealing bodies 13 has axially extending center ridges 15 which are in turn provided with mutually opposing second sealing surfaces 16 which also conform to the interior surfaces of the guide holes 11. In addition, a disk-shaped top cap 17 disposed at the rear of the liner 7 functions as a rear closing element that is both integrally rotatable with the case 2 and axially movable relative to the case and that is integrated in the rotary direction with the liner 7 by a plurality of pins 18. Furthermore, a top nut 21 is screwed into the case 2 behind the top cap 17 with a disk spring 20 between the cap 17 and the nut 21, such that by rotating the top nut 21 so as to cause the screw to travel in the forward direction, the biasing force of the disk spring 20 holds the top cap 17 against the rear of the liner 7. Reference numeral 19 designates a cylindrical connector provided with a hexagonal opening protruding from the rear of the top cap 17.

Reference numeral 22 designates the spindle of the hydraulic unit 1. Disposed at the forward end of the spindle 22 is an output shaft 23 which penetrates the bottom cap 4 and protrudes forward of the case 2 so as to be rotatably supported by the bottom cap 4. A column 24 is disposed at the rear of the spindle 22 and inserted into and rotatably supported by a closed-end hole formed in the front surface of the top cap 17. Furthermore, formed in the center of the spindle 22 within the liner 7 is a large diameter section 25 the transversal or radial cross-section of which is complementary to or snugly fits in the intermediate circle of the guide holes 11 of the liner 7. Provided through the large diameter section 25 is a pair of radially extending accommodating grooves 26 and a pair of axially disposed ribs 27 which are circumferentially 90 degrees phase-shifted from the accommodating grooves 26. Furthermore, accommodated in each groove 26 is a blade 28 that has the same axial length as that of the large diameter section 25 and is slightly circumferentially tiltable. Two coil springs 29 are interposed between and bias the blades 28 outwardly in mutually opposing directions, thus bringing the front and rear portions of the top surfaces of the blades 28 into abutment with the interior surfaces of the guide holes 11 of the liner 7. When the spindle 22 is in the rotated position shown in FIG. 1C, the contact between the blades 28 and the first sealing surfaces 14 of the liner 7 and the contact between the ribs 27 and the second sealing surfaces 16 result in the formation of four partitions in a fluid chamber 30 defined within the liner 7.

Still referring to FIG. 1, a first oblong (elongated circle) cam recess 31 and a second oblong cam recess 32 which has a longer longitudinal axis than the recess 31 are formed in the opposing inner surfaces of the bottom cap 4 and the top cap 17 (four cam trecesses altogether in the hydraulic unit 1). The longitudinal axes of the first and second cam recesses 31 and 32 lie on the same plane as those of the guide holes 11 of the liner 7. As shown in FIG. 1D, each first cam recess 31 has an oblong shape one semicircle of which is deviating or eccentric from the axis of the spindle 22, generally surrounding the output shaft 23, with its upper longitudinal end portion (as seen in FIG. 1D) located close to the outer peripheral surface of the large diameter section 25. The second cam recess 32 has a longer oblong shape than the first cam recess 31 so that both of its longitudinal end portions are located close to the outer peripheral surface of the large diameter section 25. In addition, the second cam recess 32 shares with the first recess 31 the upper (as seen in FIG. 1D) longitudinal end portion where the first recess 31 is deviated from the axis of the spindle 22. As used herein, the term "longitudinal end portion" refers to the portion of a cam recess that includes a semicircular or curved wall portion and part of the two liner wall portions connected to the semicircle wall portion. In addition, the second cam recess 32 is formed shallower than the first cam recess 31.

Provided on the front and rear end surfaces of one blade 28 are two first pins 33 which are inserted into the first cam recesses 31 and longer than the depth of the second cam recesses 32. Likewise, provided on the front and rear end surfaces of the other blade 28 are two second pins 34 which are slightly shorter than the depth of the second cam recesses 32 and inserted into the second cam recesses. Accordingly, the upper (as seen in FIG. 1) blade 28 can only protrude from the large diameter section 25 up to a certain limit due to the interference of the first pins 33 with the inner peripheral surfaces of the respective first cam recesses 31, whereas the lower blade 28 can only protrude from the large diameter section 25 up to a certain limit due to the interference of the second pins 34 with the inner peripheral surfaces of the respective second cam recesses 32. When the blades 28 are at the rotational positions where they are oriented parallel to the longitudinal axes of the first and second cam recesses 31 and 32 while in contact with the interior surfaces of the guide holes 11 (FIGS. 1C–D), the first and second pins 33 and 34 are detached from the inner peripheral surfaces of the first and second cam recesses 31 and 32. However, when the blades 28 are at the rotational position where they are oriented parallel to the widthwise axes of the first and second cam recesses 31 and 32 (the position rotated 90 degrees from that of FIGS. 1C–D), the first and second pins 33 and 34 abut the inner peripheral surfaces of the first and second cam recesses 31 and 32, respectively, thus limiting the protrusion of the blades 28. At this position, the top surfaces of the blades 28 are retracted further inward from the outer peripheral surface of the large diameter section 25 of the spindle 22 and detached from the interior surface of the guide holes 11.

Figure 2:
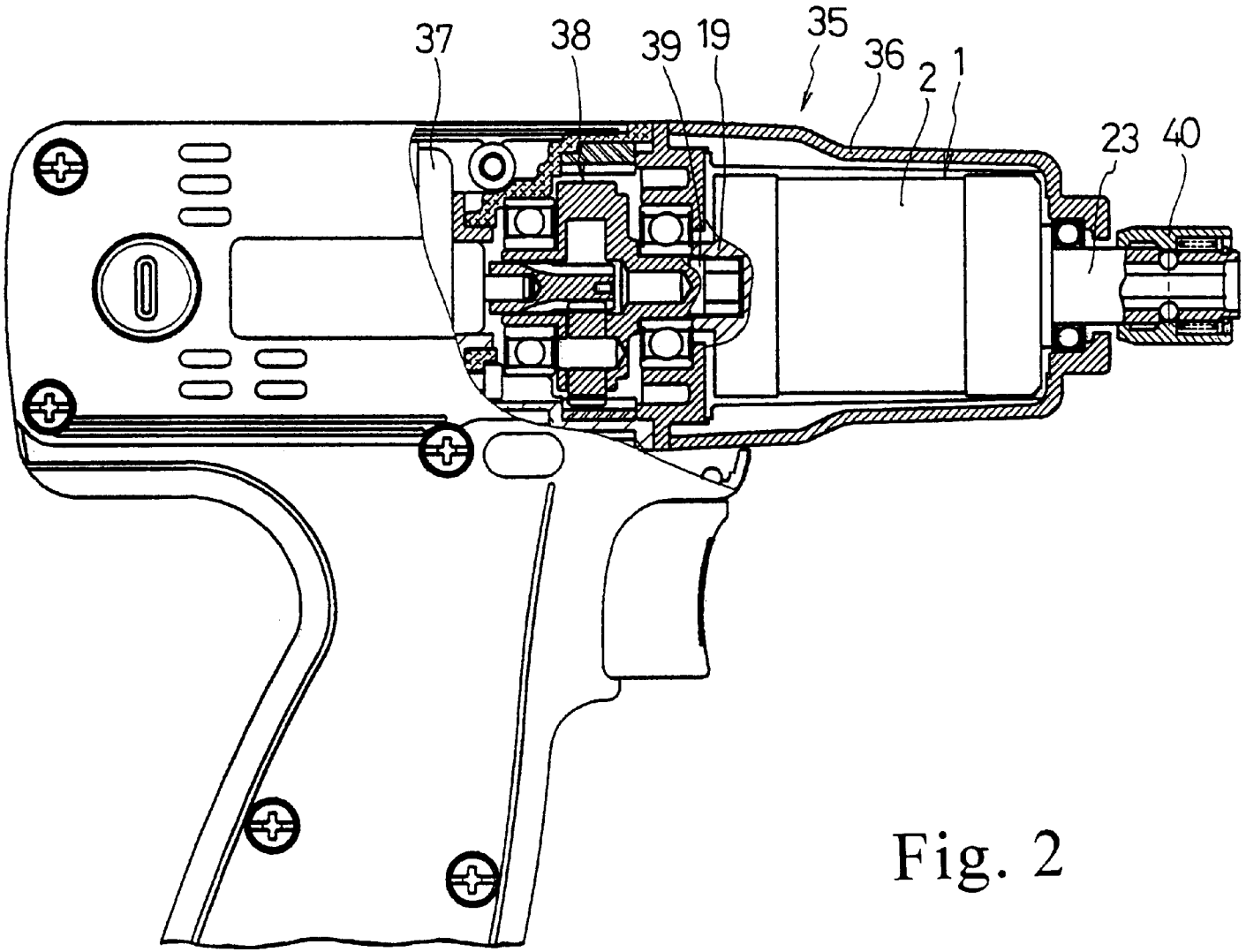
FIG. 2 is a partially cross-sectional view of an impulse screwdriver incorporating the hydraulic unit shown in FIG. 1.
Figures 3A, 3B, 3C, 3D, 3E:
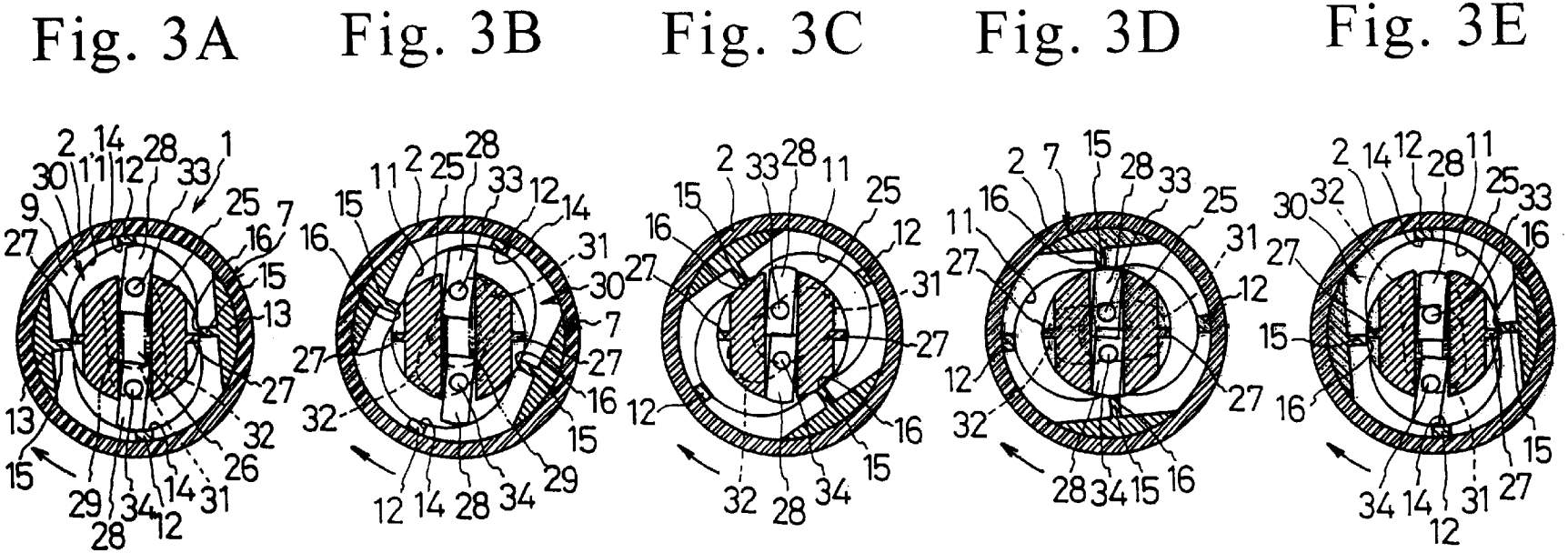
FIGS. 3A–E show in cross-section the movement of the blades with respect to the rotation of the case of the hydraulic unit of FIG. 1.

As shown in FIG. 2, for example, a hydraulic unit 1 thus constructed is installed within a housing 36 of an electric power tool such as an impulse screwdriver 35. Specifically, the connector 19 of the top cap 17 of the unit 1 is integrally coupled to the top portion of a carrier 39 of an epicycle reduction gear mechanism 38 to which rotation of a motor 37 is transmitted, whereas the output shaft 23 of the spindle 22 protrudes from the top end of the housing 36 and is fitted with a chuck 40 for attaching a tool bit thereto. Thus, when the top cap 17 and the carrier 39 rotate with the rotation of the motor 37, the liner 7 and the case 2 also rotate (rotation is counterclockwise in FIG. 3A). As shown in FIG. 3A, due to the relative rotation between the blades 28 and the liner 7, the top surfaces of the blades 23 slide on the interior surfaces of the guide holes 11 while tilted in the direction of rotation of the case 2. Upon reaching the first sealing surfaces 14, the blades 28 and the ribs 24 divide and seal the fluid chamber 30 into four partitions, thus creating alternate high and low pressure sub-chambers within the fluid chamber 30. The differential pressure thus created in the fluid chamber 30 produces impact torque to the spindle 22 via the blades 28, thus causing the spindle 22 to rotate (generation of hydraulic impulse).

Referring to FIG. 3B, as the case 2 continues its rotation, the first and second cam recesses 31 and 32 of the bottom cap 4 and the top cap 17 also rotate. Simultaneously, the first pins 33 of one of the blades 28 slide along the inner peripheral surfaces of the first cam recesses 31, whereas the second pins 34 of the other blade 28 also slide along the inner peripheral surfaces of the second cam recesses 32. As the points of contact between the pins 33 and 34 and the inner surfaces of the recesses 31 and 32 gradually approach the axis of the spindle 22, the blades 28 are gradually retracted into the large diameter sections 25 by the recesses' inner peripheral surfaces. When the blades 28 are at the position shown in FIG. 3C, where the liner 7 is about to complete approximately 90-degree rotation from the position of FIG. 3A, the blades 28 are detached from the interior surfaces of the guide holes 11. At the position shown in FIG. 3D, where the liner 7 has rotated approximately 90 degrees, the distance between the first and second pins 33 and 34 becomes shortest due to the width (widthwise axis) of the first and second cam recesses 31 and 32. This allows the blades 28 to be completely withdrawn into the large diameter portion 25 and pass by the second sealing surfaces 16 without touching these surfaces.

As the case 2 continues its rotation, one of the blades 28 gradually protrudes from the large diameter section 25 as the shorter second pins 34 are guided along the inner peripheral surfaces of the second cam recesses 32. Referring to FIG. 3E, when the liner 7 has made 180-degree rotation from the position of FIG. 3A, that blade 28 comes into contact with the first sealing surface 14. Concurrently, the longer first pins 33 of the other blade 28 are guided by the inner peripheral surfaces of the first cam recesses 31, causing that blade 28 to continue to make relative rotation without protruding from the large diameter section 25 or functioning as a seal within the fluid chamber 30 as the blade remains detached from the first sealing surface 14. Accordingly, no hydraulic impulse is generated at his position. The next hydraulic impulse is generated when the liner 7 has rotated another 180 degrees to return to the position of FIG. 3A, at which the first and second pins 33 and 34 abut the inner peripheral surfaces of the first and second cam recesses 31 and 32 again. This means that even with two blades 28 one hydraulic impulse is generated for each complete rotation of the case 2.

As described above, according to the foregoing embodiment, the longer first pins 33 protrude from the end surfaces of one blade 28, with the shorter second pins 34 protruding from the end surfaces of the other blade 28, whereas the first and second cam recesses 31 and 32 are formed in the opposing inner surfaces of the bottom cap 4 and the top cap 17 so as to guide the first and second pins 33 and 34 during the rotation of the case and for preventing the top surfaces of the blades 28 from sliding on the second sealing surfaces 16 (which are associated with, or correspond to, the ribs 27 of the spindle 22 for sealing partitioned fluid chambers). This arrangement completely eliminates the rotational resistance created by the top surfaces of the blades (1) sliding on the interior surfaces of the guide hole 11 and being pushed into the large diameter section 25 and (2) riding over the second sealing surfaces 16, thereby maximizing the torque resulting from intended hydraulic impulses. In other words, this arrangements eliminates torque "b" while augmenting torque "a" in FIG. 8.

Furthermore, the hydraulic unit of the foregoing embodiment is formed such that the deeper first cam recesses 31 for guiding the longer first pins 33 are provided in combination with the shallower second cam recesses 32 for guiding the shorter second pins 34. Additionally, each first cam recess 31 shares one curved wall portion and the liner wall portions, with its longitudinal axis shorter than that of the second cam recess 32. This design allows the first recesses 31 to guide the first pins 33 during the operation of the tool so as to prevent that blade 28 from coming into contact with one of the first sealing surfaces 14. This ensures generation of one hydraulic impulse per rotation of the case 2, which further augments the unit's output torque.

As described above, in the foregoing embodiment, the depth of the first cam recesses 31 differ from that of the second cam recesses 32 such that these recesses 31 and 32 guide the first and second pins 33 and 34, respectively, on the blades 28 in order to realize generation of a single hydraulic impulse for each rotation of the case 2. However, only one cam recess may be formed in each of the bottom and top caps and pins of the same length may be provided on the blades in order to generate two hydraulic impulses per case rotation. Even in this case, the output torque of the electric power tool can also be increased by selectively preventing contact between the blades and the guide holes 11 of the liner 7.

The number of blades need not be limited to two, as in the foregoing embodiment; the present invention can also be realized with one or three blades. Moreover, the shapes of the cam recesses are not limited to those described in the foregoing embodiment; instead, grooves having a sufficient width to accommodate the pins may be formed in an oblong loop. The recesses or the grooves may also be oval or elliptical rather than oblong as in the foregoing embodiment.

Second Embodiment

Another embodiment will be described hereinafter with reference to the attached drawings, in which identical or similar reference numerals or characters denote identical or similar parts or elements throughout the several views. Therefore, description of such elements may be omitted.

Figure 4:
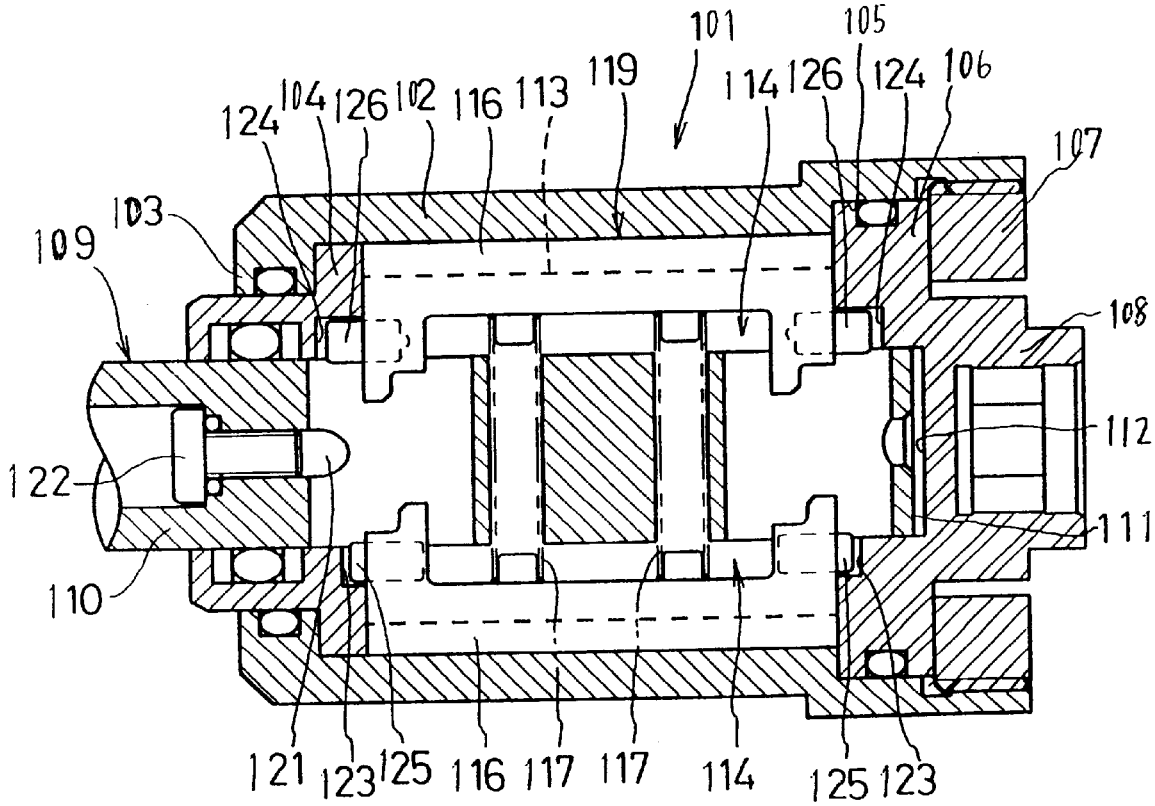
FIG. 4 is a cross-sectional view of a hydraulic unit according to an alternate embodiment of the present invention taken along the axial line.

FIG. 4 is a cross-sectional view of a hydraulic unit 101 according to an embodiment of the present invention taken along the axial line, whereas FIG. 5 illustrates operation of hydraulic unit 101 in sequence. The hydraulic unit 101 includes a cylindrical case 102. Plugging the forward part of the cylindrical case 102 (with the front of the case shown as being on the left side of FIG. 4) from the rear is a closing element such as a disk-shaped bottom cap 104 which is inserted into the cylindrical case 102 and abuts the rear surface of a restrainer 103. The bottom cap 104 is additionally prohibited from rotation with respect to the case 102 by means of a rotation stopper (not shown). The case 102 also includes at its rear end a relatively large opening 105 into which a disk-shaped top cap 106 is inserted as a rear closing element. The top cap 106 is also prohibited from rotation with respect to the case 102 by means of a rotation stopper (not shown). Screwed into the opening 105 behind the top cap 106 is a top nut 107. Accordingly, rotation of the top nut 107 causes the screw to travel in the forward direction, thus securing the top cap 106 in the case 102. Reference numeral 108 designates a cylindrical connector provided with a hexagonal opening protruding from the rear of the top cap 106 through the top nut 107.

Still referring to FIG. 4, reference numeral 109 designates the spindle of the hydraulic unit 101. Disposed at the forward end of the spindle 109 is an output shaft 110 which penetrates the bottom cap 104 and protrudes forward of the case 102. The output shaft 110 is rotatably supported by the bottom cap 104 and coaxial with circular interior surface of the case 101. A column 111 is disposed at the rear of the spindle 109 and inserted into and rotatably supported by a closed-end hole 112 formed in the front surface of the top cap 106. In addition, the column 111 is coaxial with the circular interior surface of the case 101. Furthermore, formed in the center of the spindle 109 is a large diameter section 113 whose radial cross-section is circular and essentially fills the space between the bottom cap 104 and the top cap 106. Provided through the large diameter section 113 is a pair of radially extending accommodating grooves 114 placed in communication with each other at the axial front and rear ends of the large diameter section 113. Referring to FIG. 5, additionally provided on the large diameter section 113 is a pair of axially disposed ribs 115 which are circumferentially 90 degrees phase-shifted from the accommodating grooves 114. The outer end surface of each rib 115 functions as a sealing surface (to be described in further detail below). Furthermore, accommodated in each groove 114 is a blade 116 that has the same axial length as that of the large diameter section 113 and is slightly circumferentially tiltable. Two coil springs 117 are interposed between the blades 116 in the large diameter section 113, basing the blades 116 outwardly in mutually opposing directions, thus bringing the top surfaces of the blades 116 into abutment with the interior surfaces of the case 102. A pair of sealing bodies 118 is disposed on the interior surface of the case 102 at diametrically opposite positions. Each sealing body 118 extends in parallel with the axis of the case 102 between the bottom cap 104 and the top cap 106, with its inner end surface in contact with the outer peripheral surface of the large diameter section 113 of the spindle 109.

Figures 5A, 5B, 5C, 5D, 5E, 5F, 5G, 5H, 5I, 5J, 5K, 5L:
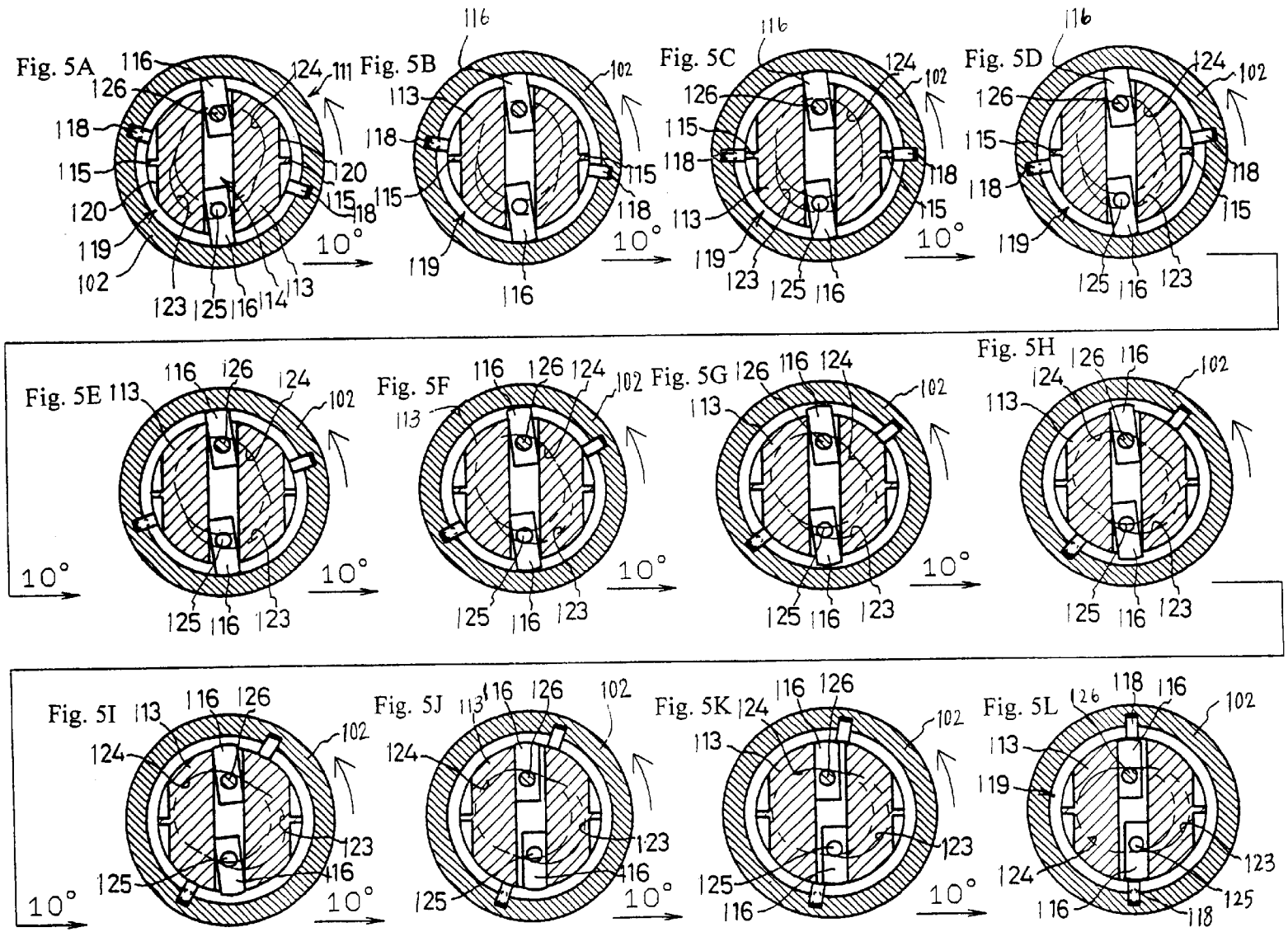
FIGS. 5A–L show the movement of the blades with respect to the case of the hydraulic unit in FIG. 4.
Figures 6A, 6B, 6C, 6D:
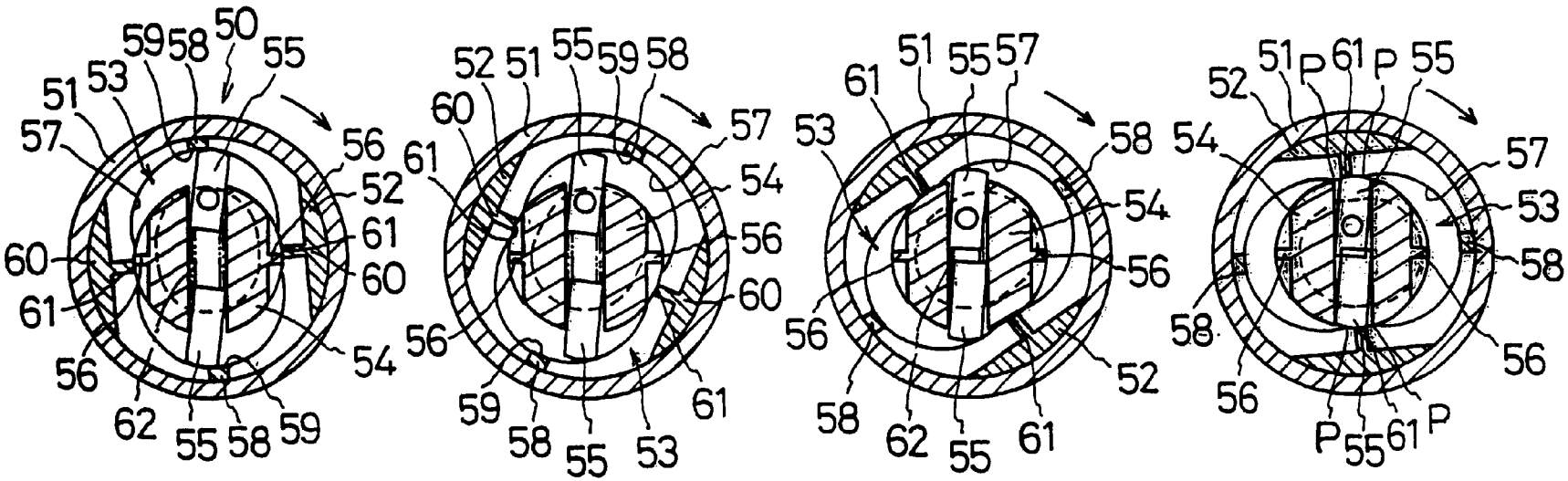
FIGS. 6A–D show in cross-section the movement of the blades with respect to the rotation of the case of a conventional hydraulic unit.
Figures 7A, 7B, 7C, 7D, 7E, 7F, 7G, 7H, 7I, 7J, 7K, 7L:
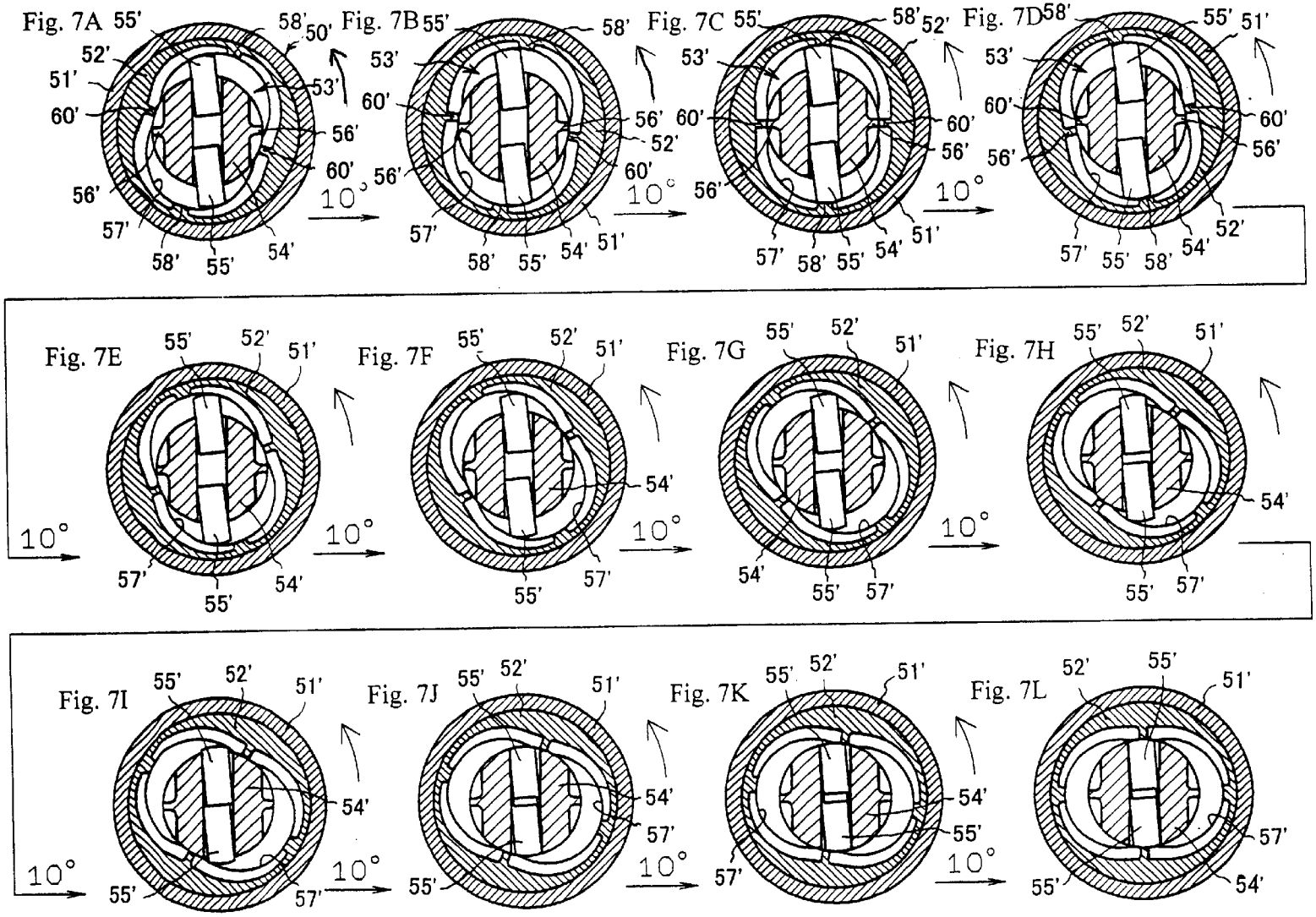
FIGS. 7A–L shows the movement of the blades with respect to the case of a conventional hydraulic unit similar to the one shown in FIG. 6.
Figure 8:
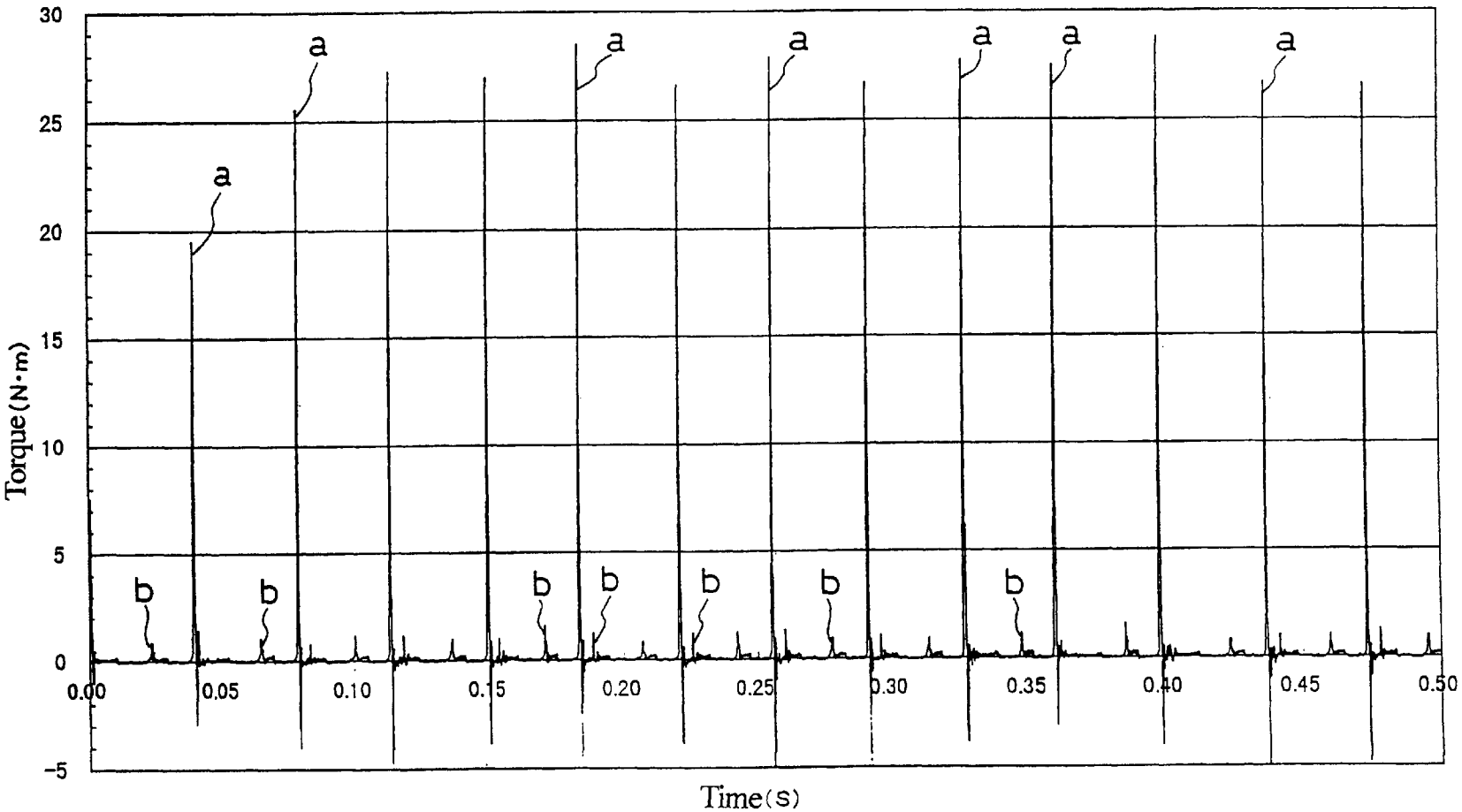
FIG. 8 is a graph showing a pattern of torque production in the hydraulic unit of FIG. 6.

When the spindle 109 is in the rotated position relative to the case 102 shown in FIG. 5C, where the blades 116 of the spindle 109 is 90 degrees phase-shifted from the sealing bodies 118 of the case 102, the blades 116 are in abutment with the interior surface of the case 102 while the sealing bodies 118 oppose the ribs 115 on the large diameter section 113, thus forming four partitions or sub-chambers in a fluid chamber 119 defined between the interior surface of the case 102 and the outer peripheral surface of the large diameter section 113. Furthermore, two pairs of mutually parallel axial chamfers 120 are cut in the large diameter section 113 to define the ribs 115, such that when the sealing bodies 118 of the case 102 are displaced by rotation from the ribs 115 of the large diameter section 113, the chamfers 120 undo the sealing provided by the sealing bodies 18 and the ribs 15. Referring to FIG. 4, a fluid feeding inlet 121 is provided in the output shaft 110 of the spindle 109 along the spindle's axis so as to be in communication with the front ends of the accommodating grooves 114. Additionally, a closing screw 22 is tightened in the inlet 121 to permit supply of working fluid into the hydraulic unit by its removal.

A first oblong (elongated circle) cam recess 123 and a second oblong cam recess 124 which has a shorter longitudinal axis than the recess 123 are formed in the opposing inner surfaces of the bottom cap 104 and the top cap 106 (four cam recesses altogether in the hydraulic unit 101). Each first cam recess 123 has a longer oblong shape than the corresponding second cam recess 124, and the center of the longitudinal axis of the first recess 123 coincides with the axis of the spindle 109. Compared with the first recesses, each second cam recess 124 has a shorter oblong shape one semicircle of which is deviating or is eccentric from the axis of the spindle 109 so as to share with the first recess one semicircular (curved) wall portion and part of the two liner wall portions (the shared area defined by the semicircular wall portion and the part of liner wall portions is hereinafter referred to as the shared longitudinal end portion). The portion of each first recess 123 not shared with the second recess 124 is made shallower than the shared end portion. The first and second cam recesses 123 and 124 in the bottom cap 4 are configured symmetrically to those in the top cap 106.

Provided on the front and rear end surfaces of one blade 116 are two first pins 125 which are inserted into the first cam recesses 123 and longer than the depth of the portion shared by the first and second recesses 123 and 124. Likewise, provided on the front and rear end surfaces of the other blade 116 are two second pins 126 each of which has a length greater a greater length than the depth of each first cam recess 123 and is inserted into the portion shared by the first and second recesses 123 and 124.

Accordingly, the lower (as seen in FIG. 4) blade 116 can only protrude from the large diameter section 113 up to a certain limit due to the interference of the first pins 125 with the inner peripheral surfaces of the respective first cam recesses 123. Likewise, the upper blade 116 can only protrude from the large diameter section 113 up to a certain limit due to the interference of the second pins 126 with the inner peripheral surfaces of the respective second cam recesses 124. As shown in FIG. 5C, when the second pins 126 are located in the portions shared by the first and second cam recesses 123 and 124 with the first and second pins 125 and 126 located on the longitudinal axes of the first and second recesses 123 and 124, the blades 116 abut the interior surface of the case 102 and detach the first and second pins 125 and 126 from the inner peripheral surfaces (wall portions) of the first and second recesses 123 and 124. Conversely, as shown in FIG. 5L, when the first and second pins 125 and 126 are located approximately on the widthwise axes of the first and second cam recesses 123 and 124, the first and second pins 125 and 126 abut the inner peripheral surfaces (wall portions) of the first and second recesses 123 and 124, thus limiting the amount of protrusion of the blades 116. Simultaneously, the top surfaces of the blades 116 are retracted inside the peripheral surface of the large diameter section 113.

For example, a hydraulic unit 101 thus constructed may be installed within a housing of an electric power tool such as an impulse screwdriver. Specifically, the connector 108 of the top cap 106 of the unit 101 is integrally coupled to the tool's output shaft to which rotation of the motor is transmitted, whereas the output shaft 110 of the spindle 109 of the hydraulic unit protrudes from the top end of the housing and is fitted with a chuck for attaching a tool bit thereto. Thus, when the top cap 106 rotates with the motor, the case 102 also rotates as indicated by the arrow (i.e., counterclockwise in FIG. 5), integrally rotating the spindle 109 via the fluid chamber 119. As shown in FIGS. 5A–B, when the rotation of the spindle 109 starts to lag behind the case's 102 rotation due to an increased load on the output shaft 110, the top surfaces of the blades 116 slide on and relative to the interior surfaces of the case 102 while tilted in the direction of rotation of the case 102. As shown in FIG. 5C, upon reaching the ribs 115 on the large diameter section 113, the sealing bodies 118 seal the fluid chamber 119. Concurrently, the tilt of the blades 116 places the two partitioned sub-chambers which are located rotationally ahead of the sealing bodies 118 in communication with each other via the blade accommodating grooves 114, increasing the pressure within these sub-chambers and thus creating alternate high and low pressure sub-chambers partitioned within the fluid chamber 119. The differential pressure thus created in the fluid chamber 119 produces impact torque to the spindle 109 via the blades 116, thereby causing the spindle 109 to rotate (generation of an hydraulic impulse).

Referring to FIGS. 5D–F, as the case 102 continues its rotation, the first and second cam recesses 123 and 124 of the bottom cap 104 and the top cap 106 also rotate. Simultaneously, the first pins 125 of one of the blades 116 slide on the inner peripheral surfaces of the first cam recesses 123, whereas the second pins 126 of the other blade 116 also slide on the inner peripheral surfaces of the second cam recesses 124. As the points of contact between the pins 125 and 126 and the inner surfaces of the respective recesses 123 and 124 gradually approach the axis of the spindle 109, the blades 116 are gradually retracted into the large diameter sections 113 by the recesses' inner peripheral surfaces (wall portions). At the position shown in FIG. 5G, the blades 116 are detached from the interior surfaces of the case 102. As shown in FIGS. 5H–K, as the case 102 continues to rotate, the blades 116 are pulled into the large diameter section 113 by the first and second cam recesses 123 and 124. At the position shown in FIG. 5L, where the case 102 has rotated approximately 90 degrees from the position of FIG. 5C, due to the length of the widthwise axis of the first and second cam recesses 123 and 124, the blades 116 are completely retracted into the large diameter section 113 and pass by the sealing bodies 118 without interference with the bodies 118.

As the case 102 continues its rotation, one of the blades 116 gradually protrudes from the large diameter section 113 and comes into contact with the case 102 again as the shorter second pins 123 are guided along the inner peripheral surfaces of the first cam recesses 123. Concurrently, the longer second pins 126 of the other blade 116 are guided by the inner peripheral surfaces of the second cam recesses 124 (which has a shorter longitudinal axis), causing that blade to continue to rotate without protruding from the large diameter section 113 into abutment with the interior surface of the case 102. Accordingly, when the case 102 rotates 90 degrees from the position of FIG. 5L, where the sealing bodies 118 reach the ribs 15, the foregoing other blade 116 does not function as a seal within the fluid chamber 119, thus generating no hydraulic impulse at this position. The next hydraulic impulse is generated when the case 102 rotates another 180 degrees to return to the position of FIG. 5C, where the second pins 126 are located in the portions shared by the first and second cam recesses 123 and 124 with the first and second pins 125 and 126 located on the longitudinal axes of the first and second recesses 123 and 124. This means that even with two blades 116, one hydraulic impulse is generated for each complete rotation of the case 102.

As described above, according to the foregoing embodiment, the interior surface of the case 102 has a circular shape coaxial with the large diameter section 113 of the spindle 109 such that the case functions as a liner of conventional hydraulic units. Furthermore, the ribs 15 and the blades 116 of the spindles 109 cooperate with the sealing bodies 118 on the interior surface of the case 102 to provide sealing within the fluid chamber 119, whereas the first and second cam recesses 123 and 124 are adapted to guide the first and second pins 25 and 26 to avoid interference between the blades 116 and the sealing bodies 118. As the simpler circular cross-section of the interior surface of the case 102 eliminates the need for high-precision polishing, as is required for complexly shaped interior surfaces of conventional units, this reduces the number of components and steps of manufacturing the unit, thus greatly lowering the cost and time of manufacturing the hydraulic unit 101

As described above, in the foregoing embodiment, the depth of the first cam recesses 123 differ from that of the second cam recesses 124 such that these recesses 123 and 124 guide the first and second pins 125 and 126, respectively, on the blades 116 in order to realize generation of a single hydraulic impulse for each rotation of the case 102. However, the present invention is applicable to an arrangement in which only one cam recess is formed in each of the bottom and top caps and pins of the same length are provided on the blades in order to generate two hydraulic impulses per case rotation.

The number of blades need not be limited to two, as in the foregoing embodiment; the present invention can also be realized with one or three blades. Moreover, the shapes of the cam recesses are not limited to those described in the foregoing embodiment; instead, grooves having a sufficient width to accommodate the pins may be formed in an oblong loop. The recesses or the grooves may also be elliptical rather than oblong as in the foregoing embodiment.

It will thus be seen that the present invention efficiently attains the characteristics set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

What is claimed is:

1. A hydraulic unit, comprising:

a case having a front closing element and a rear closing element, at least one first blade sealing surface, and at least one second blade sealing surface;

a first cam recess having a first depth and provided in each of the front closing element and the rear closing element;

a second cam recess having a second depth and provided in each of the front closing element and the rear closing element;

a spindle disposed within said case and rotatably supported by the front closing element and the rear closing element;

a first blade slidably supported by the spindle and having a first axially extending sealing surface;

a second blade slidably supported by the spindle and having a second axially extending sealing surface;

a first pair of pins disposed at a front end of the first blade and a front end of the second blade; and a second pair of pins disposed at a rear end of the first blade and a rear end of the second blade;

wherein a first pin of the first pair of pins mounts at the front end of the first blade and is received by the first cam recess provided in the front closing element, a second pin of the first pair of pins mounts at the front end of the second blade and is received by the second cam recess provided in the front closing element, a first pin of the second pair of pins mounts at the rear end of the first blade and is received by the first cam recess provided in the rear closing element, and a second pin of the second pair of pins mounts at the rear end of the second blade and is received by the second cam recess provided in the rear closing element.

2. The hydraulic unit in accordance with claim 1, wherein the spindle includes the first and second blades and the case includes two second blade-sealing surfaces;

the first blade is provided with the first pin of the first pair of pins having a first length and the first pin of the second pair of pins having the same first length;

the second blade is provided with the second pin of the first pair of pins having a second length and the second pin of the second pair of pins having the same second length, such that the second length is relatively shorter than the first length;

the first cam recess is oblong in shape and guides the first pin of the first pair of pins and the first pin of the second pair of pins, the second cam recess is oblong in shape and guides the second pin of the first pair of pins and the second pin of the second pair of pins; and the second depth is shallower than the first depth;

wherein each of the first cam recesses shares a common longitudinal end portion with each of the second cam recesses and has a shorter longitudinal axis than each of the second cam recesses such that the first blade is prevented from coming into slidable abutment with one of the second blade-sealing surfaces by the first cam recesses guiding the first pin of the first pair of pins and the first pin of the second pair of pins.

3. The hydraulic unit in accordance with claim 2, wherein while the first pins cooperating with the first cam recess prevents the first blade from coming into abutment with the at least one second blade-sealing surface, the second cam recess cooperates with the second pins to permit the second blade to protrude into abutment with the at least one second blade-sealing surface.

4. The hydraulic unit in accordance with claim 2, wherein the first blade and the second blade are disposed diametrically opposite each other about an axis of the spindle;

two ribs are positioned diametrically opposite about the axis of the spindle and 90 degrees phase-shifted from each of the first and second blades;

two rib-sealing surfaces are positioned diametrically opposite about a center axis of an interior surface of the case;

the longitudinal axes of the first cam recesses and the second cam recesses are oriented orthogonal to a diameter of the case passing through the rib-sealing surfaces; and widthwise axes of the second cam recesses pass through the axis of the spindle and are oriented orthogonal to the longitudinal axes of the first cam recesses and the second cam recesses, and a center of the second cam recess is located at the axis of the spindle;

wherein when the case is at a first rotational position, the two rib-sealing surfaces oppose the two ribs and each second pin is located on the longitudinal axis of the associated second cam recess in a longitudinal end portion of the second cam recesses not shared with the first cam recesses while each first pin is located on the longitudinal axis of the first and second cam recesses in a longitudinal end portion shared by the first and second cam recess, to allow the first and second blades to be biased into abutment with the interior surface, thus producing instantaneous torque; and at a second rotational position of the case, rotated a further 180 degrees from the first rotational position, each second pin is located on the common longitudinal axes of the first and second cam recesses in the longitudinal end portion shared by the first and second cam recesses and each first pin is located on the longitudinal axes of the first cam recess in the first cam recess longitudinal end portion not shared with the second cam recess, thus preventing the first blade from coming into abutment with the interior surface of the case.

5. The hydraulic unit in accordance with claim 4, wherein widthwise axes of the first and second cam recesses are selected to have a common and sufficiently short length to cause the first and second blades to be retracted into the spindle when the case is at a third rotational position, rotated a further 90 degrees from the first position, where the first and second pins are located approximately on the widthwise axes of the second cam recesses, with the first and second blades passing by the two rib-sealing surfaces.

6. The hydraulic unit in accordance with claim 5, wherein following the retraction of the blades into the spindle when the case is at the third rotational position, the case returns to the first rotational position upon rotating a further 270 degrees, such that instantaneous torque is produced to the spindle once for each complete rotation of the case.

7. The hydraulic unit in accordance with claim 2, wherein each of the first and second cam recesses includes a pair of opposing semicircular walls and a pair of parallel liner walls connecting the semicircular walls, thus forming a continuous loop surface extending parallel with an axis of the spindle, and further wherein each of the longitudinal end portions shared by the first cam recess and the associated second cam recess includes one semicircular wall and at least part of each liner wall.

8. The hydraulic unit in accordance with claim 2, further comprising a pair of coil springs disposed between the first and second blades within the spindle for biasing the first and second blades in outwardly radial directions, and wherein the first and second pins are inserted in the respective first and second cam recesses, and further wherein the length of each second pin is shorter than the depth of the portion shared by the first and second cam recesses and the length of each first pin is shorter than the depth of the first cam recess and greater than the depth of the portion shared by the first and the second cam recesses.

9. The hydraulic unit in accordance with claim 1, wherein the case further includes a liner which is integrally rotatable with the case and defines an interior surface of the case, and a transversal cross section of the interior surface of the case has an approximately oblong shape of a combination of three circles whose centers are located on a common straight line such that two pairs of axial ridges are symmetrically formed about the common line where an intermediate circle intersects two side circles;

wherein the case further includes two rib-sealing surfaces each located at an intermediate position between the two pairs of axial ridges on either side of the common line and flush with the interior surface of the case, and the spindle further includes a large diameter section between rear and front ends thereof, the large diameter section having a transversal cross section complementary to and snugly fitting in the intermediate circle, and the large diameter section includes two pairs of mutually parallel axial chamfers formed in an outer peripheral surface thereof to define two ribs, each between each pair of axial chamfers, such that when rib-sealing surfaces of the case are displaced by rotation from the two ribs, the two pairs of mutually parallel axial chamfers undo the sealing provided by the rib-sealing surfaces opposing the two ribs; and further wherein the rib-sealing surfaces oppose an outer peripheral surface of the large diameter section except when the rib-sealing surfaces oppose the chamfers, and further wherein the case further includes thereon two blade-sealing surfaces which are 90 degree phase-shifted from the rib-sealing surfaces.

10. A hydraulic unit comprising:

a generally cylindrical case containing working fluid, the case including an interior surface, front and rear closing elements at two axial ends thereof, and at least one first blade-sealing surface and at least one second rib-sealing surface;

a spindle inserted into the case and having front and rear ends rotatably supported by the front and rear closing elements, respectively, the spindle further including at regular intervals at least one blade and at least one rib for circumferentially partitioning an interior of the case into a plurality of smaller fluid chambers, wherein relative rotation between the case and the spindle causes top surfaces of the at least one blade and the at least one rib to slide along the interior surface of the case to create differential pressure among the smaller fluid chambers when the top surfaces of the at least one blade and the at least one rib reach the at least one blade-sealing surface and the at least one second rib-sealing surface, respectively, thus generating instantaneous torque to the spindle;

pairs of pins provided on axial front and rear ends of each blade; and cam recesses provided in opposing inner surfaces of the closing elements of the case, wherein during rotation of the case, the cam recesses guide the pairs of pins and prevent the top surfaces of the at least one blade from sliding on the at least one second rib-sealing surface.

11. The hydraulic unit in accordance with claim 10, wherein the spindle includes a first blade and a second blade and the case includes two second blade-sealing surfaces, the first blade is provided with two first pins;

the second blade is provided with two second pins shorter than the first pins; and each closing element includes in an inner surface a first oblong cam recess for guiding one of the first pins and a second oblong cam recess shallower than the first cam recess for guiding one of the second pins, wherein each first cam recess shares a common longitudinal end portion with the second cam recess and has a shorter longitudinal axis than the second cam recess, such that the first blade is prevented from coming into slidable abutment with the two second blade-sealing surfaces by the first cam recess guiding the first pins.

12. The hydraulic unit in accordance with claim 11, wherein while the first cam recess prevents the first blade from coming into abutment with one of the blade-sealing surfaces, the second cam recess cooperates with the second pins to permit the second blade to protrude into abutment with the other blade-sealing surface.

13. The hydraulic unit in accordance with claim 11, wherein the first and second blades are located diametrically opposite about an axis of the spindle;

two ribs are positioned diametrically opposite about the axis of the spindle and 90 degrees phase-shifted from the first and second blades;

two rib-sealing surfaces are positioned diametrically opposite about the center axis of the interior surface of the case; and longitudinal axes of the first and second cam recesses are oriented orthogonal to a diameter of the case passing through the two rib-sealing surfaces;

widthwise axes of the second cam recesses pass through the axis of the spindle and are oriented orthogonal to the longitudinal axes of the first and second cam recesses, and a center of the second cam recess is located at the axis of the spindle;

wherein when the case is at a first rotational position, the two rib-sealing surfaces oppose the two ribs and each second pin is located on the longitudinal axis of the associated second cam recess in the longitudinal end portion of the second cam recess not shared with the first cam recess, while each first pin is located on the longitudinal axis of the first and second cam recesses in the longitudinal end portion shared by the first and second cam recesses to allow the first and second blades to be biased into abutment with the interior surface of the case, thus producing instantaneous torque; and at a second rotational position of the case, rotated a further 180 degrees from the first rotational position, each second pin is located on the common longitudinal axes of the first and second cam recesses in the longitudinal end portion shared by the first and second cam recesses and each first pin is located on the longitudinal axes of the first cam recess in the first cam longitudinal end portion not shared with the second cam recess, thus preventing the first blade from coming into abutment with the interior surface.

14. The hydraulic unit in accordance with claim 13, wherein the widthwise axes of the first and second cam recesses are selected to have a common and sufficiently short length to cause the first and second blades to be retracted into the spindle when the case is at a third rotational position, rotated a further 90 degrees from the first position, where the first and second pins are located approximately on the widthwise axes of the second cam recesses, with the first and second blades passing by the two rib-sealing surfaces.

15. The hydraulic unit in accordance with claim 14, wherein following retraction of the first and second blades into the spindle when the case is at the third rotational position, the case returns to the first rotational position upon rotating a further 270 degrees, such that instantaneous torque is produced to the spindle once for each complete rotation of the case.

16. The hydraulic unit in accordance with claim 11, wherein each of the first and second cam recesses includes a pair of opposing semicircular walls and a pair of parallel liner walls connecting the semicircular walls, thus forming a continuous loop surface extending parallel with the axis of the spindle, and further wherein each of the longitudinal end portions shared by the first cam recess and the associated second cam recess includes one semicircular wall and at least part of each liner wall.

17. The hydraulic unit in accordance with claim 11, further comprising a pair of coil springs disposed between the first and second blades within the spindle for biasing the first and second blades in outwardly radial directions, and wherein the first and second pins are inserted in the respective first and second cam recesses, and further wherein the length of each second pin is shorter than the portion shared by the first and second cam recesses and the length of each first pin is shorter than the depth of the first cam recess and greater than the depth of the portion shared by the first and the second cam recesses.

18. The hydraulic unit in accordance with claim 10, wherein the case further includes a liner integrally rotatable with the case and defines the interior surface of the case, and a transversal cross section of the interior surface of the case has an approximately oblong shape of a combination of three circles whose centers are located on a common straight line, such that two pairs of axial ridges are symmetrically formed about the common line where an intermediate circle intersects two side circles;

wherein the case further includes two rib-sealing surfaces each located at an intermediate position between the two pairs of axial ridges on either side of the common line and flush with the interior surface of the case, and the spindle further includes a large diameter section between rear and front ends thereof, the large diameter section having a transversal cross section complementary to and snugly fitting in the intermediate circle, and the large diameter section including two pairs of mutually parallel axial chamfers formed in an outer peripheral surface thereof to define two ribs each between each pair if mutually parallel axial chamfers, such that when the rib-sealing surfaces of the case are displaced by rotation from the two ribs, the mutually parallel axial chamfers undo the sealing provided by the two rib-sealing surfaces opposing the two ribs;

further wherein the two rib-sealing surfaces oppose an outer peripheral surface of the large diameter section except when the two rib-sealing surfaces oppose the mutually parallel axial chamfers; and further wherein the case further includes thereon two blade-sealing surfaces which are 90 degree phase-shifted from the two rib-sealing surfaces.

* * * * *